US007514627B2

(12) United States Patent
Kato et al.

(10) Patent No.: US 7,514,627 B2
(45) Date of Patent: Apr. 7, 2009

(54) KEYBOARD MUSICAL INSTRUMENT HAVING SENSOR UNIT EXACTLY LOCATED BY MEANS OF PLURAL LOCATORS

(75) Inventors: Tadaharu Kato, Shizuoka-ken (JP); Shigeru Muramatsu, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 661 days.

(21) Appl. No.: 11/088,037

(22) Filed: Mar. 23, 2005

(65) Prior Publication Data

US 2005/0241461 A1 Nov. 3, 2005

(30) Foreign Application Priority Data

Apr. 14, 2004 (JP) ..... 2004-119400

(51) Int. Cl.
*G10H 1/34* (2006.01)
*G10H 3/00* (2006.01)
*G10D 16/00* (2006.01)

(52) U.S. Cl. ..... 84/745; 84/171; 84/21

(58) Field of Classification Search ..... 84/719, 84/744, 13, 21, 171, 745
See application file for complete search history.

(56) References Cited

U.S. PATENT DOCUMENTS 5,459,282 A * 10/1995 Willis ..... 84/645
5,546,842 A * 8/1996 Pimentel ..... 84/461
5,583,310 A * 12/1996 Sugiyama et al. ..... 84/719
5,719,347 A * 2/1998 Masubuchi et al. ..... 84/687
5,741,995 A 4/1998 Kawamura et al.
6,011,214 A * 1/2000 Kawamura ..... 84/719
6,712,323 B1 * 3/2004 Cheung et al. ..... 248/201
6,846,982 B2 * 1/2005 Sato ..... 84/745
7,132,643 B2 * 11/2006 Kato ..... 250/221
7,227,069 B1 * 6/2007 Sanderson ..... 84/423 R
2002/0194986 A1 12/2002 Kato et al.
2003/0070526 A1 4/2003 Muramatsu et al.
2003/0202834 A1 * 10/2003 Sato ..... 400/491.3
2004/0163526 A1 * 8/2004 Muramatsu ..... 84/13

FOREIGN PATENT DOCUMENTS

JP 8087269 4/1996

* cited by examiner

*Primary Examiner*—Jeffrey Donels
(74) *Attorney, Agent, or Firm*—Harness, Dickey & Pierce, PLC

(57) ABSTRACT

A hybrid keyboard musical instrument is fabricated on a piano, and a hammer stopper and an electronic tone generating system are installed in the piano; the electronic tone generating system includes hammer sensors arranged on a framework secured to a shank flange rail by means of stud bolts, and the stud bolts and spacer nuts, which are threaded with the stud bolts, serve as locators for locating the sensors at target relative positions with respect to the hammers independently in the fore-and-aft direction and up-and-down direction; the framework is pressed to the spacer nuts with nuts driven into the stud bolts so that the framework is removable from and reassembled with the shank flange rail without loosening the stud bolts.

19 Claims, 8 Drawing Sheets

KEYBOARD MUSICAL INSTRUMENT HAVING SENSOR UNIT EXACTLY LOCATED BY MEANS OF PLURAL LOCATORS

FIELD OF THE INVENTION

This invention relates to a keyboard musical instrument and, more particularly, to a keyboard musical instrument having moving objects such as, for example, hammers monitored with sensors.

DESCRIPTION OF THE RELATED ART

A hybrid musical instrument is fabricated on the basis of an acoustic musical instrument, and an electronic system is installed in the acoustic musical instrument for generating electronic tones. A mute piano is an example of the hybrid musical instrument, and a piano, a hammer stopper and an electronic tone generating system are incorporated in the automatic player piano. A pianist enjoys the acoustic piano tones produced along a music passage through fingering on the keyboard. When he or she does not wish to disturb the neighborhood, he or she moves the hammer stopper into the trajectories of the hammers, and fingers a piece of music on the keyboard. Since the hammers rebound on the hammer stopper before reaching the strings, any acoustic piano tone is not produced, and electronic tones are produced through the electronic tone generating system. In order to produce the electronic tones, it is necessary to exactly detect the key motion and hammer motion. For this reason, an array of key sensors and an array of hammer sensors are installed in the acoustic piano.

A typical example of the mute piano is disclosed in Japanese Patent Application laid-open No. Hei 8-87269. Since an automatic playing system is further incorporated in the prior art mute piano, the key sensors and hammer sensors are shared between the electronic tone generating system and the recorder, which forms a part of the automatic playing system. Eighty-eight keys usually form the keyboard, and, eighty-eight hammers are selectively driven for rotation by the depressed keys through the action units. Accordingly, eighty-eight key sensors monitor the key motion of the associated keys, and eighty-eight hammer sensors are also required for the hammers. Thus, the large number of key sensors/hammer sensors are required for the hybrid musical instrument.

If the relative positions between the hammers and the hammer sensors are not guaranteed to be sure, the detecting signals, which are output from the hammer sensors, describe the hammer motion from different viewpoints, and, accordingly, the electronic tones are produced at loudness different from that intended by the pianist. In order faithfully to produce the electronic tones at the intended loudness, the eighty-eight hammer sensors are to be installed exactly at the relative positions with respect to the associated hammers. For this reason, it is proposed in the Japanese Patent Application laid-open that the hammer sensors are located at target relative positions through deformation of a resilient member, which retains the hammer sensors by driving a screw, the tip of which is held in contact with the free end of the resilient member.

A problem is encountered in the prior art supporting structure in that a fine control is required for the hammer sensors.

SUMMARY OF THE INVENTION

It is therefore an important object of the present invention to provide a keyboard musical instrument, sensors of which are exactly located at target relative positions with respect to moving objects without complicated work.

The present inventors contemplated the problem inherent in the prior art disclosed in the Japanese Patent Application laid-open, and noticed that the resilient member had varied the relative position in the fore-and-aft direction in dependence on the relative position in the up-and-down direction through the deformation thereof. In other words, when a worker varied the height of the hammer sensors, the hammer sensors got close to or spaced from the hammers in the fore-and-aft direction. The present inventors concluded that the sensors had to be located at target relative positions by means of plural locators, which were to be provided on a common reference member such as, for example, the center rail, shank flange rail or balance rail and which permitted a designer independently to determine the target relative position at least in the fore-and-aft direction and in the up-and-down direction.

In accordance with one aspect of the present invention, there is provided a hybrid keyboard musical instrument comprising an acoustic musical instrument including a cabinet including a common reference member and having a fore-and-aft direction, a lateral direction crossing the fore-and-aft direction at right angle and an up-and-down direction normal to a plane defined by the fore-and-aft direction and lateral direction, link works independently actuated in a performance for specifying the pitch of tones to be produced and respectively having certain links supported by the common reference member so as to be moved with respect to the common reference member and a tone generator energized through the link works and producing the tones at the pitch specified through the actuated link works, an electric system including a sensor unit having a framework supported by the common reference member and sensors supported by the framework and converting a physical quantity expressing the motion of the certain links to detecting signals and a data processor connected to the sensors and producing pieces of music data through an analysis on the physical quantity, and plural locators provided on the common reference member and engaged with the framework so as to locate the sensors at target relative positions with respect to the certain links independently determined in at least the fore-and-aft direction and the up-and-down direction.

BRIEF DESCRIPTION OF THE DRAWINGS

The features and advantages of the keyboard musical instrument will be more clearly understood from the following description taken in conjunction with the accompanying drawings, in which.

DESCRIPTION OF THE PREFERRED EMBODIMENTS

Figure 1:
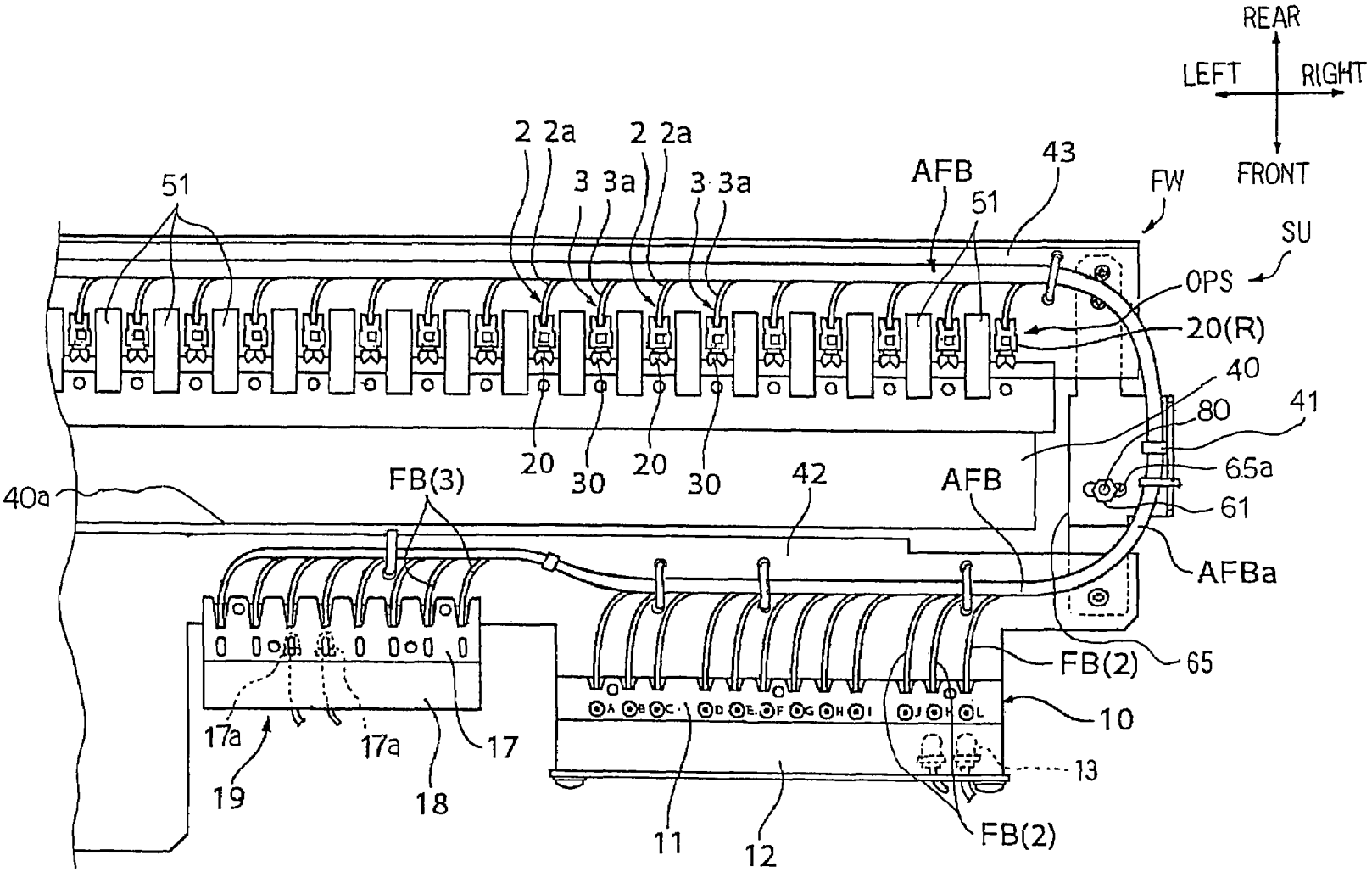
FIG. 1 is a plane view showing the arrangement of component parts of a hammer sensor incorporated in a hybrid keyboard musical instrument according to the present invention for a higher pitched part.

A hybrid keyboard musical instrument according to the present invention is broken down into an acoustic keyboard musical instrument, an electric system and plural locators. The acoustic keyboard musical instrument includes link works for relaying intention of a player to a tone generator. In case where an acoustic piano serves as the acoustic keyboard musical instrument, black and white keys, action units and hammers form the link works, and relays the intention of a pianist to strings. The strings vibrate for producing tones so as to serve as the tone generator.

At least a sensor unit and a data processor are incorporated in the electric system. The sensor unit includes sensors provided on a framework, and the sensors monitor certain links respectively forming parts of the link works. Since the intention of player is relayed through the link works to the tone generator, the motion of the certain links also expresses the intention of player. For this reason, the sensors convert the physical quantity, which expresses the motion of the certain links, to detecting signal.

The detecting signals are supplied to the data processor. A computer program runs on the data processor, and determines attributes of tones such as, for example, the loudness, pitch, timing at which the tones are to be produced, timing at which the tones are to be decayed and effects to be imparted to the tones through the analysis on the physical quantity. The data processor produces pieces of music data representative of the tones, and supplies the pieces of music data to an electronic tone generator, a data storage and/or an external musical instrument, by way of example.

As described hereinbefore, it is important exactly to determine the physical quantity. If the relative positions between the sensors and the certain links are unintentionally varied, the variation unavoidably has an influence on the physical quantity represented by the detecting signals, and a calibration is required for the sensors. In order to make the detecting signals reliable, it is necessary to keep the sensors at target relative positions with respect to the certain links. Locators make the sensors and certain links stay at the target relative position, and are desirable from the viewpoint of the reliability. Moreover, the locators are conducive to the speed-up in the assembling work.

If the locators are provided on a component member regardless of the certain links, the locators can not guarantee the target relative positions for the sensors, because the component member may unintentionally change its relative position with respect to another member which offers a center of motion to the certain links. For this reason, the locators are provided on a common reference member, and the common reference member is shared with the certain links.

Another factor to be considered is the independence among the locators. If a locator forces a designer to determine a target relative position in not only the fore-and-aft direction but also the up-and-down direction, it is hard for the designer to locate the sensors at the optimum target relative position. The designer may have to make a target relative position in the fore-and-aft direction compromise with a target relative position in the up-and-down direction.

According to the present invention, plural locators are provided on the common reference member, and permit a designer independently to determine the target relative position between the sensors and the certain links at least in the fore-and-aft direction and up-and-down direction. The locators not only keep the sensors at the target relative positions with respect to the certain links regardless of a repairing work on the sensor unit but also make the assembling work or reassembling work easy and speedy.

Various locators are available for the hybrid keyboard musical instrument according to the present invention. A pin, a stud bolt or a set key may be used between the common reference member and a framework by which the sensors are supported. Well-finished surfaces of the common reference member can serve as the locator. The framework may be spaced from the common reference member in the up-and-down direction by means of a nut, which may be held in threaded engagement with the stud bolt, a spacer or the set key. In the preferred embodiments described hereinafter, several locators are selectively employed therein, and are described in detail.

When a manufacturer designs the locators, a designer takes the independence at least between the location in the fore-and-aft direction and the location in the up-and-down direction into account. The designer may further takes the location in the lateral direction into account. The plural locators accurately provided on the common reference member make the framework and, accordingly, sensors exactly located at the target relative positions without any fine position control, and keeps the sensors at the target relative positions. Even if the sensor unit is removed from the common reference member for a repairing work, the worker can reassemble the sensor unit with the common reference member without any calibration work on the sensors. Thus, the plural locators make the reassembling work easy and speedy.

First Embodiment

Figure 2:
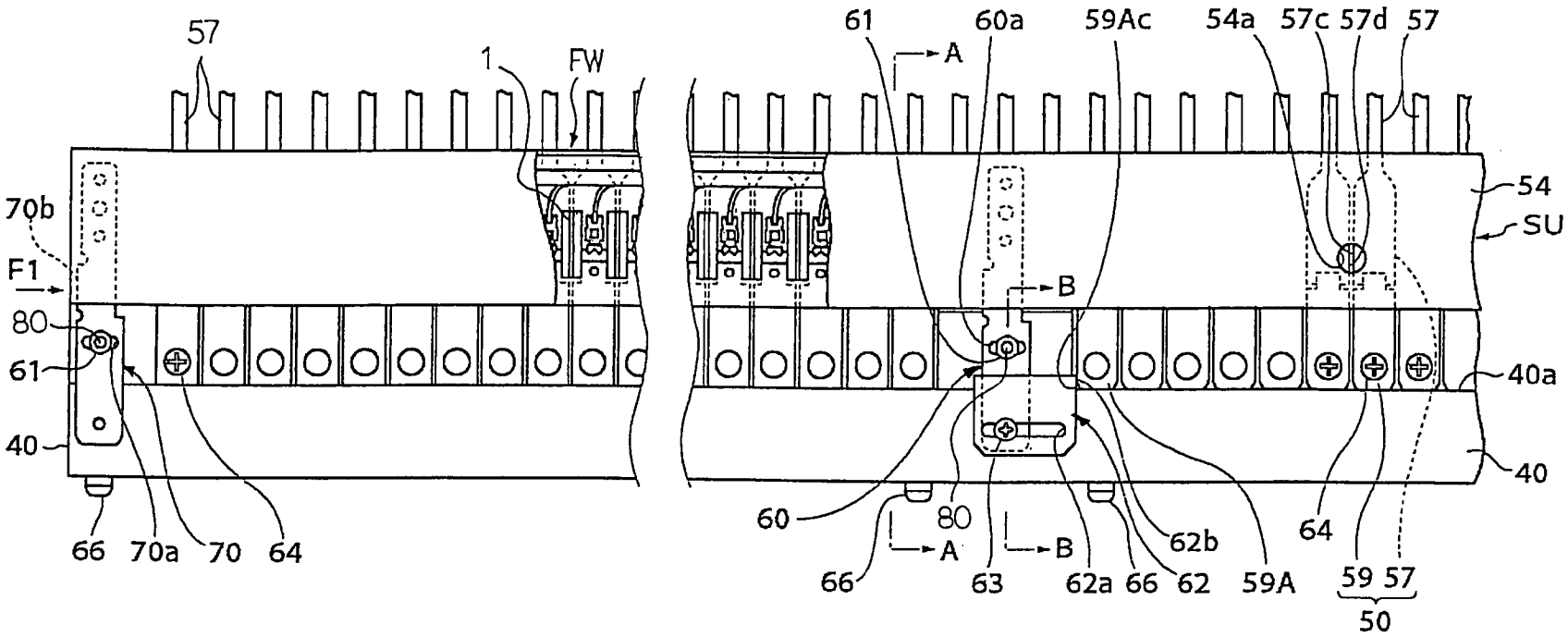
FIG. 2 is a plane view showing the arrangement of component parts of the hammer sensor unit for lower and middle pitched parts.
Figure 3:
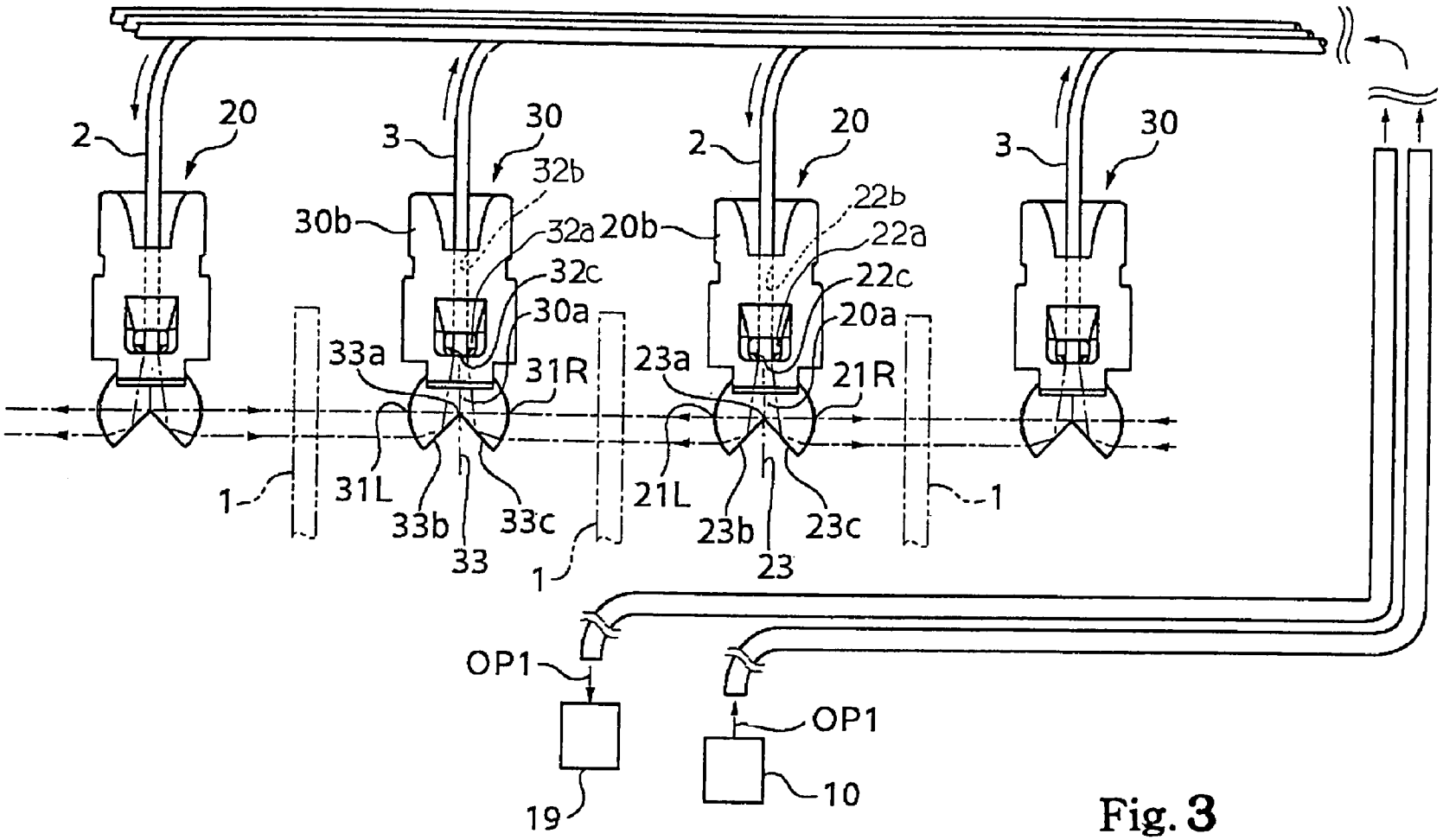
FIG. 3 is a plane view showing sensor heads incorporated in the hammer sensor unit.

In the following description, relative positions are modified with terms "front", "rear", "right" and "left" as indicated by arrows shown in FIG. 1. FIG. 1 shows a hammer sensor unit SU. Term "fore-and-aft" direction is in parallel to the arrow drawn between the "front" and "rear", and term "lateral" direction is in parallel to the arrow drawn between the "left" and "right". Although the hammer sensor unit SU is hidden under a cover plate 54, the cover plate 54 is removed from a framework FW so that component parts of the hammer sensor unit SU are exposed to the outside in FIG. 1. The component parts of the hammer sensor unit SU shown in FIG. 1 are associated with a higher pitched part, and the component parts shown in FIG. 2 are associated with a middle pitched part and a lower pitched part. FIG. 3 shows relative positions assigned to some component parts of the hammer sensor unit SU.

Figure 4:
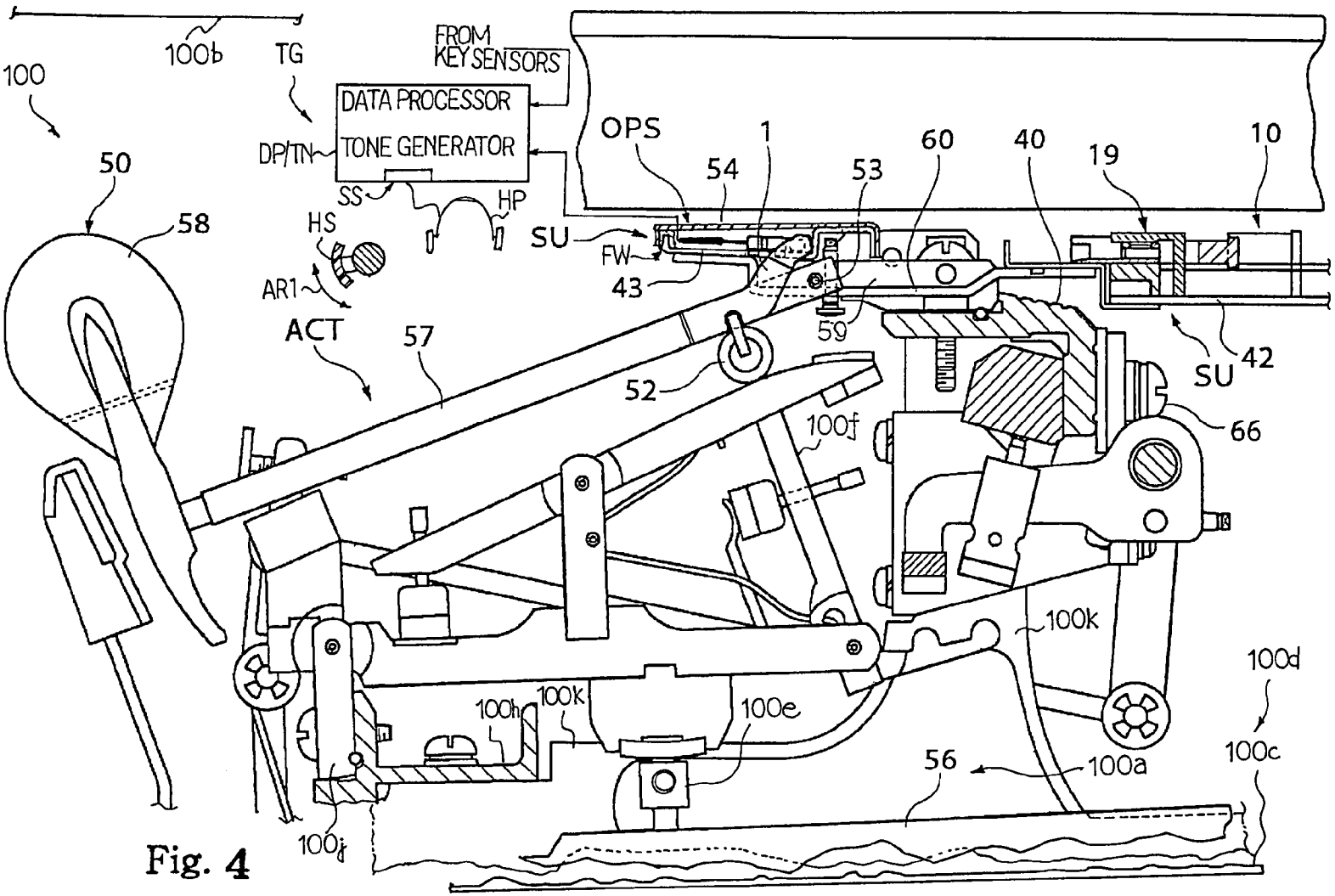
FIG. 4 is a side view showing the hammer sensor unit installed in the keyboard musical instrument.
Figure 5:
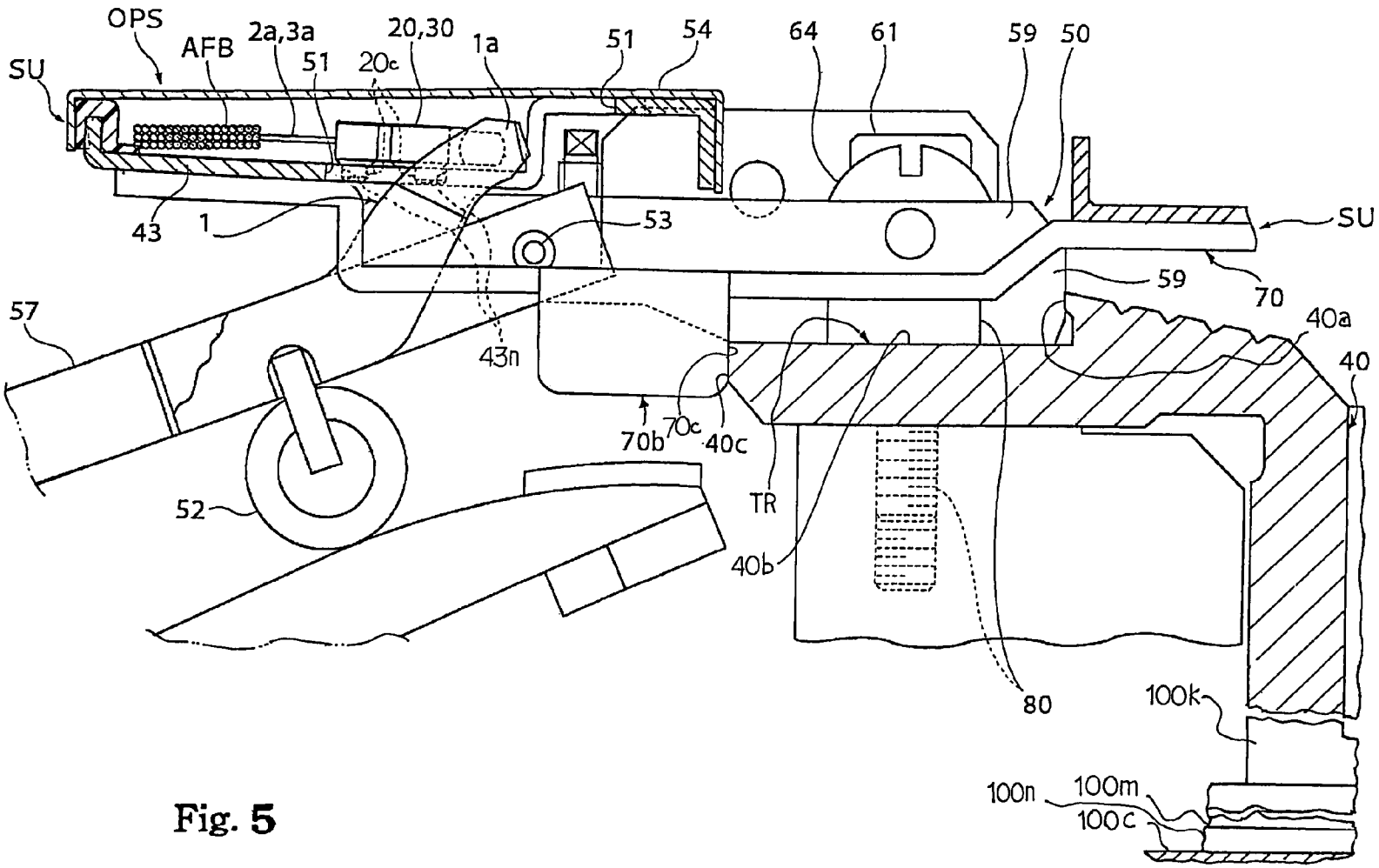
FIG. 5 is a cross sectional view taken along line A-A of FIG. 4 and showing the hammer sensor unit and associated hammer at a large magnification ratio.

Description is firstly made on a hybrid keyboard musical instrument with reference to FIGS. 4 and 5. The hybrid keyboard musical instrument is of the type having a hammer stopper HS and an electronic tone generating system TG. In other words, the hybrid keyboard musical instrument largely comprises an acoustic piano 100, the hammer stopper HS, electronic tone generating system TG and an acoustic piano 100. The hammer stopper HS is installed in the acoustic piano 100, and is changed between a free position and a blocking position. When a pianist wishes to perform a piece of music through acoustic piano tones, he or she changes the hammer stopper HS to the free position so that the hammer stopper HS permits the acoustic piano 100 to produce the acoustic piano tones. On the other hand, if the pianist wishes to practice the piece of music without any acoustic piano tone, he or she changes the hammer stopper HS to the blocking position. The hammer stopper HS prohibits the acoustic piano 100 from producing the acoustic piano tones at the blocking position, and the electronic tone generating system TG produces electronic tones, which are corresponding to the missing piano tones, so that the pianist hears the electronic tones without disturbance to the neighborhood.

The acoustic piano 100 includes a keyboard 100*a*, which has plural black/white keys 56, action units ACT, hammers 50 and strings 100*b*. In this instance, eighty-eight keys 56 are incorporated in the keyboard 100*a*, and are laid on the well-known pattern in the lateral direction. The keyboard 100*a* is mounted on a front portion of a key bed 100*c*, and is exposed to a pianist who is sitting on a stool (not shown) for the fingering on the keyboard 100*a*. The key bed 100*c* forms a bottom part of a piano cabinet 100*d*, and the action units ACT, hammers 50, strings 100*b* and hammer stopper HS are housed in the piano cabinet 100*d*.

The black/white keys 56 are respectively linked with the action units ACT by means of capstan screws 100*e*, and the hammers 50 rest on jacks 100*f*. The action units ACT are supported by a whippen rail 100*h* through whippen flanges 100*j*, and the whippen rail 100*h* is supported by action brackets 100*k*, and the action brackets 100*k* are bolted to bracket blocks 100*m* (see FIG. 5). The bracket blocks 100*m* are mounted on a key frame 100*n*, which is provided on the key bed 100*c*, so that the key bed 100*c* bears the weight of the action units ACT. The structure and behavior of the action unit ACT are known to persons skilled in the art, and no further description is hereinafter incorporated for the sake of simplicity.

In this instance, the hammers 50 are movable along respective trajectories in the space under the strings 100*b*, and the hammer stopper HS laterally extends between the hammers 50 and the strings 100*b*. The hammer stopper HS is moved into and out of the trajectories of the hammers 50 through rotation indicated by arrow AR1. The hammer stopper HS enters the free position through the rotation in the clockwise direction and the blocking position through the rotation in the counter clockwise direction.

Each of the hammers 50 includes a hammer shank 57, a hammer felt 58, a hammer shank flange 59, a hammer roller 52 and a drop screw 53. The hammer felt 58 is secured to the leading end of the hammer shank 57, and the hammer shank 57 is rotatably connected at the other end to the hammer shank flange 59 by means of the drop screw 53. The hammer roller 52 is rotatably connected to the hammer shank 57. While the associated black/white key 56 is resting at the rest position, the hammer roller 52 is held in contact with the upper surface of the jack 100*f* as shown in FIG. 4. However, when the jack 100*f* escapes from the hammer 50, the jack 100*f* kicks the hammer roller 52 so that the hammer 50 starts free rotation toward the associated string 100*b*.

The hammer shank flanges 59 are secured to a shank flange rail 40, which in turn is bolted to the action brackets 100*k* laterally arranged at intervals over the key frame 100*n* on the key bed 100*c*, by means of bolts 64. Thus, the key bed 100*c* also bears the weight of the hammers 50 and hammer sensor unit SU. The shank flange rail 40 is shared between the hammers 50 and the hammer sensor unit SU, and the shank flange rail 40 makes the hammer sensor unit SU exactly located at a target relative position with respect to the array of hammers 50.

The electronic tone generating system TG includes a key sensor unit, a data processor/tone generator DP/TN, a sound system SS, in which a headphone HP is incorporated, and the hammer sensor unit SU. The key sensor unit is provided under the keyboard 100*a*, and includes plural optical key sensors, which monitor the associated black/white keys 56, respectively. The key sensor unit is connected to the data processor DP, and key position signals, which represent current key positions, are supplied from the optical key sensors to the data processor DP. The hammer sensor unit SU is provided in association with the hammers 50, and is also connected to the data processor DP. Hammer position signals, which represent current hammer positions, are supplied from the hammer sensor unit SU to the data processor DP. The data processor DP periodically fetches pieces of key position data, which are carried on the key position signals, and pieces of hammer position data, which are carried on the hammer position signals, and analyzes the pieces of key position data and pieces of hammer position data so as to determine key motion and hammer motion. The key motion and hammer motion result in the piano tones so that the data processor DP determines the tones to be produced. The data processor DP produces music data codes, and supplies the music data codes to the tone generator TN. The tone generator TN produces an audio signal from pieces of waveform data read out on the basis of the music data codes, and supplies the audio signal to the sound system SS. Then, the audio signal is converted to the electronic tones. The pianist may hear the electronic tones through the headphone HP.

Description is hereinafter focused on the hammer sensor unit SU with reference to FIGS. 1, 2 and 3. As described hereinbefore, the framework FW and cover plate 54 are two component parts of the hammer sensor unit SU. The framework FW is secured to the shank flange rail 40 by means of positioning bolts/nuts 80/61, and the shank flange rail 40 is secured to the action brackets 100*k* by means of the positioning bolts 80. The positioning bolts 80 may be categorized in a stud bolt. The shank flange rail 40 is shared between the framework FW and the hammers 50, and make the framework FW exactly located at a target relative position with respect to the hammers 50 as will be hereinlater described in more detail. The cover plate 54 is put on and assembled with the framework FW, and prohibits the light and dust from entry into the inner space.

The hammer sensor unit SU further includes an array OPS of optical sensor heads 2/3, a light emitting unit 10, a light detecting unit 19, a major bundle AFB of optical fibers and optical filters 1. The optical filters 1 are attached to the boss portions of the hammer shanks 57 (see FIGS. 4 and 5), and a gray scale 1*a* is printed on the side surface of each of the optical filters 1. This results in that the gray scale 1*a* is rotated about the drip pin 53 together with the hammer shank 57. The transmittance of the gray scale 1*a* is continuously varied so that the amount of light passing through the optical filter 1 is determined depending upon the angular position of the hammer 50 during the rotation of the hammer 50 about the hammer shank flange 59.

The framework FW includes a front base plate 42, which is assigned to the light emitting unit 10, light detecting unit 19 and an electric circuit board (not shown), a rear base plate 43, which is assigned to the array of optical sensor heads 20/30, and connector plates 60, 65 and 70. Although only one connector plate 65 and two connector plates 60 and 70 are shown in FIGS. 1 and 2, respectively, the framework FW has more than three connector plates connected between the front base plate 42 and the rear base plate 43 at intervals in the lateral direction. The connectors 60, 65 and 70 make the front base plate 42 and rear base plate 43 integrated into the framework FW, and the framework FW is bolted to the shank flange rail 40 at the connector plates 60, 65 and 70 and other connector plates. In the following description, only the three connector plates 60, 65 and 70 are referred to. However, the description on the connector plates 60, 65 and 70 are applicable to the other connector plates.

Holes 60*a*, 65*a* and 70*a* are formed in the connector plates 60, 65 and 70, and are laterally elongated. However, the length of the holes 60*a*, 65*a* and 70*a* are shorter than the width of the slits 51. The positioning bolts 80 pass through the holes 60*a*, 65*a* and 70*a*, and the nuts 61 are brought into meshing engagement with the positioning bolts 80 so as to press the framework FW to the shank flange rail 40. Since the holes 60*a*, 65*a* and 70*a* are laterally elongated, the framework FW is movable on the shank flange rail 40 in the lateral direction, and, is, accordingly, regulable in position with respect to the shank flange rail 40 and, accordingly, the hammers 50.

The rear base plate 43 is covered with the cover plate 54 so that the rear base plate 43 and cover plate 54 keep the inner space dark. In other words, the optical sensor heads 20 and 30 are prevented from the environmental light.

Slits 51 are formed in the rear base plate 42 at intervals in the lateral direction, and the intervals of the slits 51 are equal to the intervals of the hammer shanks 57. The optical filters 1 project through the slits 51 into the inner space between the framework FW and the cover plate 54 during the rotation of the associated hammers 50 toward the strings 100*b*, and are retracted from the inner space during the reverse rotation of the hammers 50 after the strike on the strings 100*b* or rebound on the hammer stopper HS.

Light radiating sensor heads 20 and light receiving sensor heads 30 are alternately arranged on the upper surface of the rear base plate 43 at intervals in the lateral direction, and are secured to the rear base plate 43. Each of the light radiating sensor heads 20 is opposed to the light receiving sensor heads 30 across the slits 51, and forms two sensor head pairs together with the light receiving sensor heads 30 on both sides thereof. Each of the sensor head pairs is associated with one of the hammers 50 for monitoring the hammer motion of the associated hammer 50.

The light radiating sensor heads 20 and light receiving sensor heads 30 are secured to the upper surface of the front base plate 42, and are laterally spaced from each other. The light radiating sensor heads 20 and light receiving sensor heads 30 are optically connected to the light emitting unit 10 and light detecting unit 19 through the major bundle AFB of optical fibers 2/3. The major bundle AFB laterally extends on the rear base plate 43, and the optical fibers 2 and optical fibers alternately branch at intervals from the major bundle AFB. The optical fibers 2 and 3 are warped from the major bundle AFB as indicated by references 2*a* and 3*a*, and are connected to the light radiating sensor heads 20 and light receiving sensor heads 30, respectively.

The major bundle AFB passes through the connector plate 65, and is warped thereon. The warped portion of the major bundle AFB is labeled with "AFBa", and the major bundle AFB is bonded to the front base plate 42, rear base plate 43 and connector plate 65 by means of strips at intervals. The strip, which is used for the warped portion AFBa, is labeled with reference numeral 41.

The major bundle AFB of optical fibers includes plural minor bundles FB(2) of optical fibers 2 and plural minor bundles FB(3) of optical fibers 3. Several optical fibers 2 form each minor bundle FB(2), and several optical fibers 3 form each minor bundle FB(3). The minor bundles FB(3) branch off from the major bundle AFB at intervals on the left area on the front base plate 42, and the minor bundles FB(2) branch off from the major bundle AFB at intervals between the minor bundles FB(3) and the warped portion AFBa.

Twelve light emitting elements 13 are incorporated in the light emitting unit 10. The light emitting unit 10 has a socket 12, and the twelve light emitting elements 13, which may be implemented by semiconductor light emitting diodes, are retained inside the socket 12. The light emitting unit 10 further has a plug 11, and twelve ports "A" to "L" are formed in the plug 11. The twelve minor bundles FB(2) are terminated at the ports "A" to "L", and are opposed to the light emitting elements 13 inside the light emitting unit 10, respectively.

The twelve light emitting elements 13 are respectively assigned twelve time slots, and are sequentially energized. When the light emitting element 13 is energized, light is emitted from the light emitting element 13, and is incident on the associated minor bundle FB(2), i.e., the end surfaces of the optical fibers 2. The light is propagated through the optical fibers 2, and reaches the associated light radiating sensor heads 2. Since the light emitting elements 13 are energized for an extremely short time, the emitted light is recognized as a light pulse.

Eight light detecting elements 17*a* are incorporated in the light detecting unit 19. The light detecting unit 19 has a socket 18, and the light detecting elements 17*a*, which may be implemented by semiconductor light detecting transistors, are retained inside the socket 18. The light detecting unit 19 further has a plug 17, and eight ports are formed in the plug 17. The minor bundles FB(3) are terminated at the ports, and are respectively opposed to the light detecting elements 17*a* inside the light detecting unit 19. The light concurrently returns from associated eight light receiving sensor heads 30 through the respective eight minor bundles FB(3), and is converted to photo current through the eight light detecting elements 17*a*. Since only one optical fiber 3 of each minor bundle FB(3) guides the light from the light receiving sensor head 30 to the light detecting unit 19, the light detecting element 17*a* produces the photo-current exactly equivalent to the amount of light passing through the optical filter 1 of the associated hammer 50. In other words, more than one optical fiber of each minor bundle FB(3) does not concurrently guide the light to the light detecting unit 19.

The twelve minor bundles FB(2) and eight minor bundles FB(3) result in ninety-six combinations, and only eighty-eight combinations are respectively assigned to the eighty-eight hammers 50. For this reason, it is possible to specify the hammer 50 with the combination. The scanning technique and identification are disclosed in Japanese Patent Application laid-open No. Hei 9-152871.

The light radiating sensor heads 20 are made of transparent material such as, for example, acrylic resin, and are similar in structure to one another. The light radiation sensor heads 20 and light receiving sensor heads 30 may be made through a plastic molding. For this reason, only one light radiating sensor head 20 is described with reference to FIG. 3.

The light radiating sensor head 20 is broken down into a head portion 20*a* and a retainer 20*b*. The retainer 20*b* has a generally rectangular and parallelepiped configuration, and the head portion 20*a* forwardly projects from the retainer 20*b*. Though not shown in the drawings, the retainer 20*b* is formed with tenons 20*c* (see FIG. 5), and mortises 43*n* are formed in the rear base plate 43. When the tenons 20*c* are pressed into the mortises 43*n*, the light radiating sensor head 20 is exactly located at a target position on the rear base plate 43, and is secured to the rear base plate 43.

The retainer 20*b* is formed with a hole 22*b*, which is approximately equal in diameter to the optical fiber 2, and the hole 22*b* extends from the rear end surface along a line of symmetry 23 of the light radiating sensor head 20. The retainer 20*b* is further formed with a pit 22*a*, and the hole 22*b* is open to the pit. A dish-like receiver 22*c* is further formed with the retainer 20*b*. The dish-like receiver 22*c* is provided on the line of symmetry 23, and rearward projects into the pit 22*a*. The optical fiber 2 is connected to the light radiating sensor head 20 as follows. The optical fiber 2 is pressed into the hole 22*b* from the rear end surface. The optical fiber 2 advances toward the disk-like receiver 22*c* through the hole 22*b*, and reaches the disk-like receiver 22*c*. The optical fiber 2 is strongly pushed. Then, the optical fiber 2 is snugly received in the dish-like receiver 22*c*, and the end surface of the optical fiber 2 is brought into contact with the inner wall defining the front end of the pit 22*a*. The optical fiber 2 is grasped with the dish-like receiver 22*c*, and is connected to the light radiating sensor head 20.

The head portion 20*a* has a pair of convex lenses 21R and 21L and a pair of reflecting surfaces 23*b* and 23*c*. The reflecting surfaces 23*b* and 23*c* are inclined at 45 degrees from the line of symmetry 23, and abut on each other. The abutting line 23*a* crosses the line of symmetry 23 at right angle. The convex lenses 21R and 21L sideward project toward the adjacent light receiving sensor heads 30.

The light emitting unit 10 is assumed to emit light OP1. The light OP1 is propagated through the optical fiber 2, and reaches the light radiating sensor head 20. The light OP1 proceeds through the light radiating sensor head 20, and is reflected on the reflection surfaces 23*b* and 23*c*. Then, the light OP1 is split into two light beams, and the light beams are sideward radiated toward the adjacent light receiving sensor heads 30.

The light receiving sensor head 30 is also broken down into a head portion 30*a* and a retainer 30*b*. The head portion 30*a* is same as the head portion, and the retainer 30*b* is same as the retainer 20*b*. For this reason, corresponding hole, pit, receiver, line, lenses and reflection surfaces are labeled with references, in which the number of tens is changed from "2" to "3". As described hereinbefore, the light OP1 does not concurrently reach the light radiating sensor heads 20 on both sides of each light receiving sensor head 30. For this reason, the light OP1 is incident on either right convex lens 31R or left convex lens 31L. The light OP1 is reflected on the reflecting surface 33*c* or 33*b*, and is directed to the end surface of the optical fiber 3. The light OP1 is propagated through the optical fiber 3, and reaches the light detecting unit 19. The light-to-current conversion is well known to the persons skilled in the art, and no further description is hereinafter incorporated for the sake of simplicity.

Turning back to FIG. 5, description is focused on how the shank flange rail 40 retains the hammers 50 and optical sensor unit SU at the target relative position. The shank flange rail 40 is formed with a terrace TR. The terrace TR is defined by a front vertical surface 40*a*, a flat wide surface 40*b* and a rear vertical surface 40*c*. These surfaces 40*a*, 40*b* and 40*c* are exactly measured, and are well finished. For this reason, the front vertical surface 40*a* is spaced from the rear vertical surface 40*c* by a predetermined distance, and the front vertical surface 40*a* and rear vertical surface 40*c* extend at 90 degrees with respect to the flat wide surface 40*b*.

The hammer shank flanges 59 are held in abutting engagement at the front surface with the front vertical surface 40*a*, and the bolt 64 makes bottom surface of the hammer shank flange 59 tightly held in contact with the flat wide surface 40*b*. For this reason, the hammer shank flanges 59 are exactly located at respective target positions on the shank flange rail 40. Especially, the front vertical surface 40*a* makes the hammer shank flanges 59 exactly located at the target positions in the fore-and-aft direction of the acoustic piano 100, and the optical filters 1 are exactly spaced from the front vertical surface 40*a* by a target distance.

Although the connector plate 70 is hereinafter described, the description is also applicable to the connector plates 60 and 65 and other connector plates. A reference block 70*b* is integral with the connector plate 70, and downwardly projects from the connector plate 70. The reference block 70*b* has a well-finished front surface 70*c*, and the well-finished front surface 70*c* is spaced from the mortises 43*n* by a predetermined distance. For this reason, when the well-finished front surface 70*c* is brought into abutting engagement with the rear vertical surface 40*c*, the mortises 43*n* and, accordingly, the sensor heads 20/30 are exactly spaced from the front vertical surface 40*a* by a target distance. As described hereinbefore, the optical filters 1 are exactly spaced from the front vertical surface by the target distance, and the optical sensor heads 20 and 30 are exactly spaced from the front vertical surface by the target distance, i.e., the sum of the predetermined distance between the mortises 43*n* and the well-finished front surface 70*c*/rear vertical surface 40*c* and the predetermined distance between the rear vertical surface 40*c* and the front vertical surface 40*a*. Thus, the optical sensor unit SU or the sensor heads 20/30 are located at the target relative positions with respect to the hammers 50 and the optical filters 1.

The framework FW is provided with a locator 62 as shown in FIG. 2. A threaded hole is formed in the connector plate 60, and the locator 62 is held in abutting engagement with the array of hammers 50 by means of a bolt 63 through a hole 62*a*. Since the hole 62*a* is elongated in the lateral direction, the locator 62 is movable in the lateral direction with respect to the connector plate 62 and, accordingly, the framework FW. When the framework FW is adjusted to the proper position in the lateral direction with respect to the array of hammers 50, a projection 62*b* of the locator 62 is brought into abutting engagement with the hammer shank flange 59 of one of the hammers 50, and the bolt 63 is driven into the threaded hole through the hole 62*a* so that the locator 62 is secured to the connector plate 60. Even though the hammer sensor unit SU is removed from the shank flange rail 40, the locator 62 guides the worker to position the framework FW at the proper position in the reassembling work. Thus, the hammer sensor unit SU is quickly located at the previous position by the aid of the locator 62.

Figure 6A:
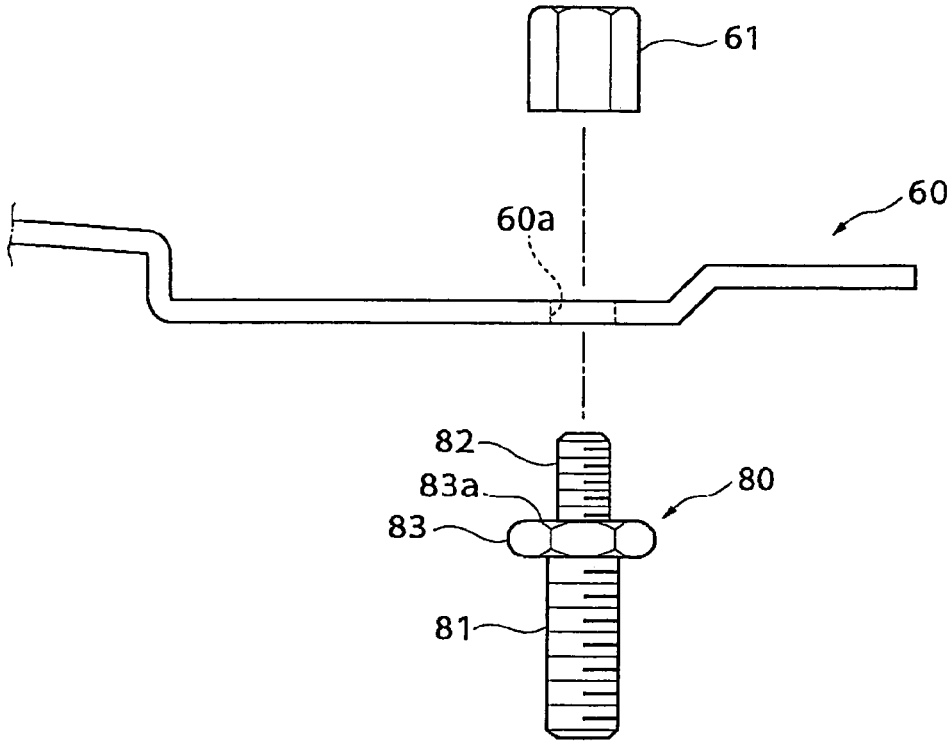
FIGS. 6A and 6B are side views showing a method for assembling the hammers and hammer sensors with a hammer shank rail.
Figure 6B:
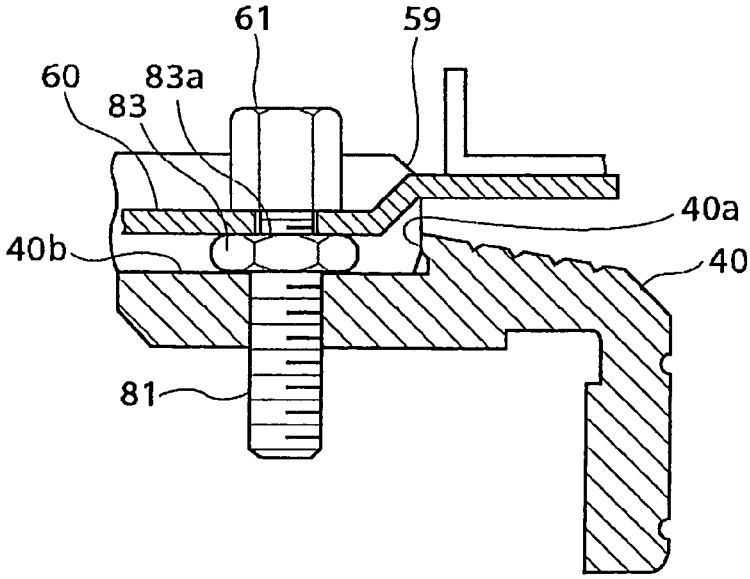

FIG. 6A shows the positioning bolt 80 and nut 61 before the assemblage, and FIG. 6B shows the positioning bolt 80 and nut 61 after the assemblage. The cross section shown in FIG. 6B is taken along line B-B of FIG. 2.

The hammer sensor unit SU is installed in the acoustic piano 100 as follows. The optical filters 1 have been already attached to the hammer shanks 57, respectively. Firstly, a worker brings the hammer shank flanges 59 into contact with the front vertical surface 40*a*, and bolts the hammer shank flanges 59 to the shank flange rail 40. The hammers 50 are arrayed in the lateral direction, and keep the optical filters 1 at respective target positions in the fore-and-aft direction with respect to the shank flange rail 40.

Subsequently, the positioning bolts 80 are driven into the holes already formed in the shank flange rail 40. Each of the positioning bolts 80 has a lower threaded portion 81, an upper threaded portion 82 and a spacer nut 83. The lower threaded portion 81 is thicker than the upper threaded portion 82 so that a step is formed at the boundary between the lower threaded portion 81 and the upper threaded portion 82. The spacer nuts 83 are adjusted to the optimum thickness, which makes the gray scales 1*a* spaced from the bottom surface of the rear base plate 43 and, accordingly, the optical paths between the light radiating sensor heads 20 and the adjacent light receiving sensor heads 30 by a target distance. The spacer nut 83 is brought into threaded engagement with the upper threaded portion 82, and stops at the step.

While the worker is driving the lower threaded portion 81 into the shank flange rail 40, the spacer nut 83 gets closer and closer to the upper surface of the shank flange rail 40. When the spacer nut 83 is brought into contact with the upper surface of the shank flange rail 40, the positioning bolt 80 is properly embedded into the shank flange rail at the target position where the positioning bolts 80 roughly locate the framework FW at the target relative position in the lateral direction with respect to the array of hammers 50.

The framework FW, light radiating sensor heads 20, light receiving sensor heads 30, light emitting unit 10, light detecting unit 19 and major bundle AFB have been already assembled into the hammer sensor unit SU. The hammer sensor unit SU is moved into the space over the shank flange rail 40, and gradually descends to the shank flange rail 40. The worker aligns the holes 60*a*, 65*a* and 70*a* with the upper threaded portions 82, and makes the upper threaded portions 82 pass through the holes 60*a*. Although the holes 60*a*, 65*a* and 70*a* are laterally elongated as described hereinbefore, the length of the holes 60*a*, 65*a* and 70*a* is shorter than the width of the slits 51, and the positioning bolts 80 are embedded in the shank flange rail 40 at the position where the framework FW is properly located at the target relative position with respect to the array of hammers 50 and, accordingly, the optical filters 1. The optical filters 1 are almost aligned with the slits 51 in the lateral direction. The rough alignment with the elongated holes 60*a*, 65*a* and 70*a* is desirable, because the optical filters 1 are prevented from the collision with the bottom surface of the rear base plate 43.

The worker brings the framework FW and the reference block 70*b* into contact with the spacer nut 83 and rear vertical surface 40*c*, respectively, so that the framework FW and slits 51 are located at the target relative position in the fore-and-aft direction, at the target relative position in the up-and-down direction and almost at the target relative position in the lateral direction.

Subsequently, the worker exactly locates the framework FW at the target relative position in the lateral direction through a fin control. As shown in FIG. 2, the cover plate 54 is formed with an inspection hole 54*a*. Since the inspection hole 54*a* is located at a position where the optical filters 1 are coincident with the center lines of the associated slits 51 in so far as the center lines between the side surfaces 57*c* and 57*d* of the adjacent hammer shanks 57 are found on the diameter, which is in parallel to the side surfaces 57*c* and 57*d* of the inspection hole 54*a*. The worker delicately moves the framework FW in the lateral direction, and makes the diameter aligned with the center lines between the side surfaces 57*c* and 57*d*. When the diameter is found on the centerline, the worker drives the nuts 61 into the upper threaded portions 82 as shown in FIG. 6B so that the frameworks FW is secured to the shank flange rail 40 at the target relative position in the lateral direction.

Finally, the worker brings the projection 62*b* into contact with the left side surface of the hammer shank flange 59A on the right side, and tightens the locator 62 to the connector plate 60 by means of the bolt 63.

As will be understood from the foregoing description, the framework FW is exactly positioned at the target relative positions in the fore-and-aft direction, lateral direction and up-and-down direction with respect to the array of hammers 50, because the shank flange rail 40 is shared between the hammers 50 and the framework FW as a common reference member. This results in that the assembling work is made easy and speedy. For this reason, the production cost is drastically reduced.

Especially, the locating bolts 80 not only adjust the framework FW to the target relative position in the up-and-down direction but also prevent the shank flange rail 40 from undesirable deformation. In case where the shank flange rail 40 is made of soft metal such as, for example, aluminum through an extrusion, the shank flange rail 40 tends to be deformed due to the force exerted thereon by the bolts 64 and bolts, which makes the framework FW secured to the shank flange rail 40. In this situation, the hammer sensors 10/19/20/30 are calibrated with respect to the optical filters 1. After the delivery to a user, the optical sensor unit SU is assumed to be separated from the shank flange rail 40 for a repairing work. Upon completion of the repairing work, the hammer sensor unit SU is assembled with the hank flange rail 40, again. The worker tightens the framework FW to the shank flange rail 40 by means of the bolts, again. However, it is impossible to press the framework FW to the hammer shank flange 40 at the force exactly equal to that before the separation. This means that the shank flange rail 40 is differently deformed, and the hammer sensors 10/19/20/30 are to be calibrated, again. On the contrary, the positioning bolts 80 make the calibration unnecessary after the repairing work, because the framework FW is released from the spacer nuts 61. The positioning bolts 80 are not loosed, and the constant force is exerted on the shank flange rail 40 before and after the repairing work. In other words, the deformation of the shank flange rail 40 is unchanged. For this reason, the calibration work is not necessary after the separation of the hammer sensor unit SU from the shank flange rail 40.

Moreover, even though the hammer sensor unit SU is removed from the shank flange rail 40 for a repairing work, the reference block 70*b*, locator 62, spacer nut 83 permit the worker exactly locate the framework FW at the target relative positions without any fine control.

Second Embodiment

Figure 7:
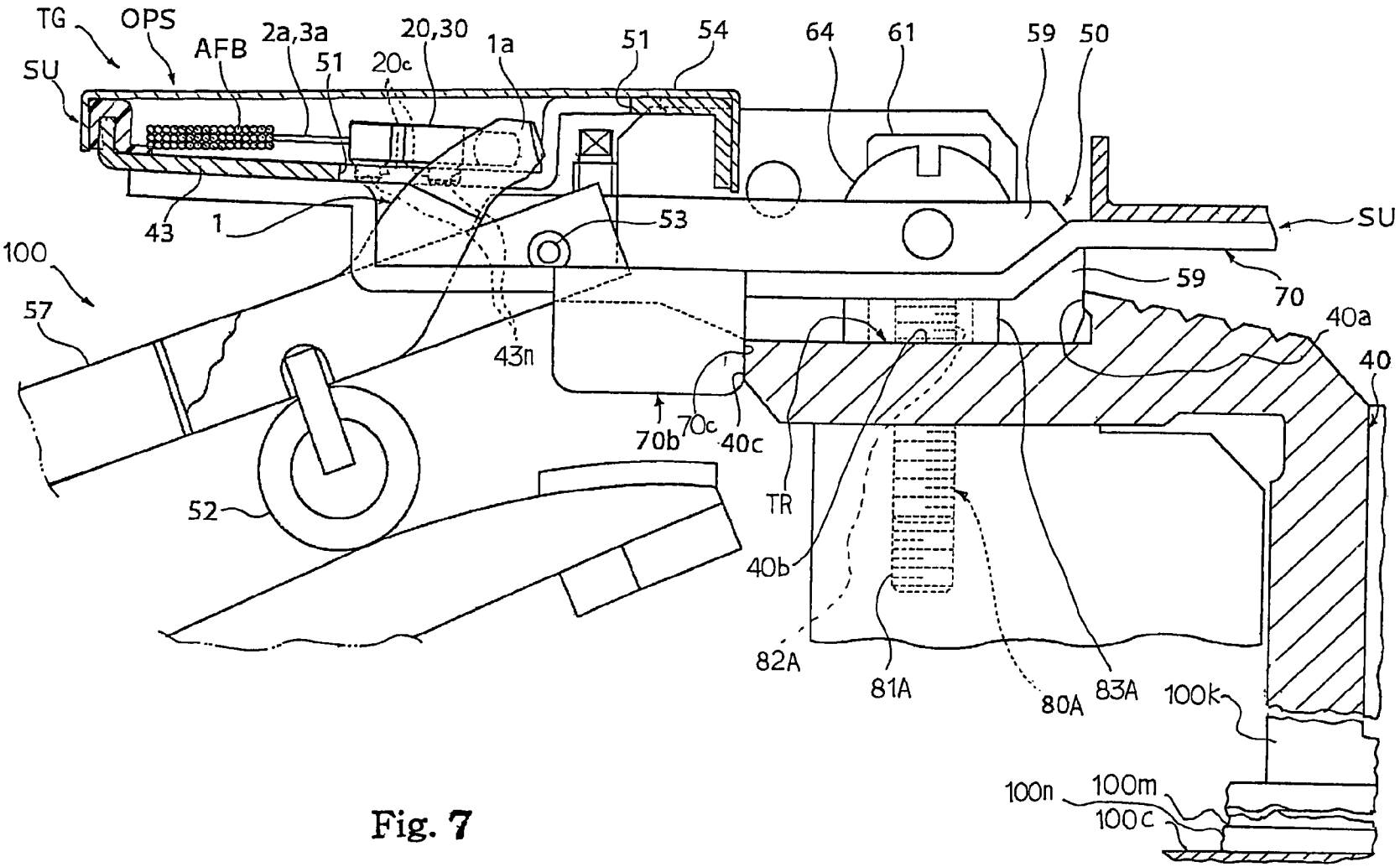
FIG. 7 is a cross sectional view showing essential parts of another hybrid keyboard musical instrument according to the present invention.

FIG. 7 shows the hammer sensor unit SU secured to the shank flange rail 40 of the acoustic piano 100 at the target relative positions in the fore-and-aft direction, lateral direction and up-and-down direction. The hammer sensor unit SU forms a part of the electronic tone generating system TG, which in turn forms parts of a hybrid keyboard musical instrument according to the present invention together with the acoustic piano 100.

The hybrid keyboard musical instrument implementing the second embodiment is similar in structure to the hybrid keyboard musical instrument of the first embodiment except a positioning bolt 80A and a ring spacer 83A. For this reason, description is focused on these different parts 80A and 83A, and other component parts are labeled with same references designating corresponding parts shown in FIGS. 1 to 6B without detailed description for the sake of simplicity.

Although the positioning bolts 80 make the framework FW located at the target relative position in the fore-and-aft direction, at the target relative position in the up-and-down direction and at the almost target relative position in the lateral direction, the positioning bolts 80A make the framework FW located at the target relative position in the fore-and-aft direction and at the almost target relative position in the lateral direction, only. For this reason, the positioning bolts 80A has the lower threaded portion 81A and upper threaded portion 82A, and any spacer nut is not formed in the positioning bolt 80A.

The framework FW is located at the target relative position in the up-and-down direction by means of the ring spacers 83B. The ring spacers 83B have a predetermined thickness, which makes the lower surface of the rear base plate 43 spaced from the gray scales 1*a*. For this reason, after the positioning bolts 80A are embedded into the shank flange rail 40, the worker places the ring spacers on the upper surface 40*b* around the positioning bolts 80A, and, thereafter, puts the framework FW on the ring spacers 83A.

The hybrid keyboard musical instrument implementing the second embodiment achieves all the advantages of the first embodiment by virtue of the positioning bolts 80A, the well-finished surfaces 40*a*, 40*b* and 40*c*, reference block 70*b*, inspection hole 4*a* and ring spacers 83A. The locator 62 also makes the reassembling work easy and speedy as similar to that in the first embodiment.

Third Embodiment

Figure 8:
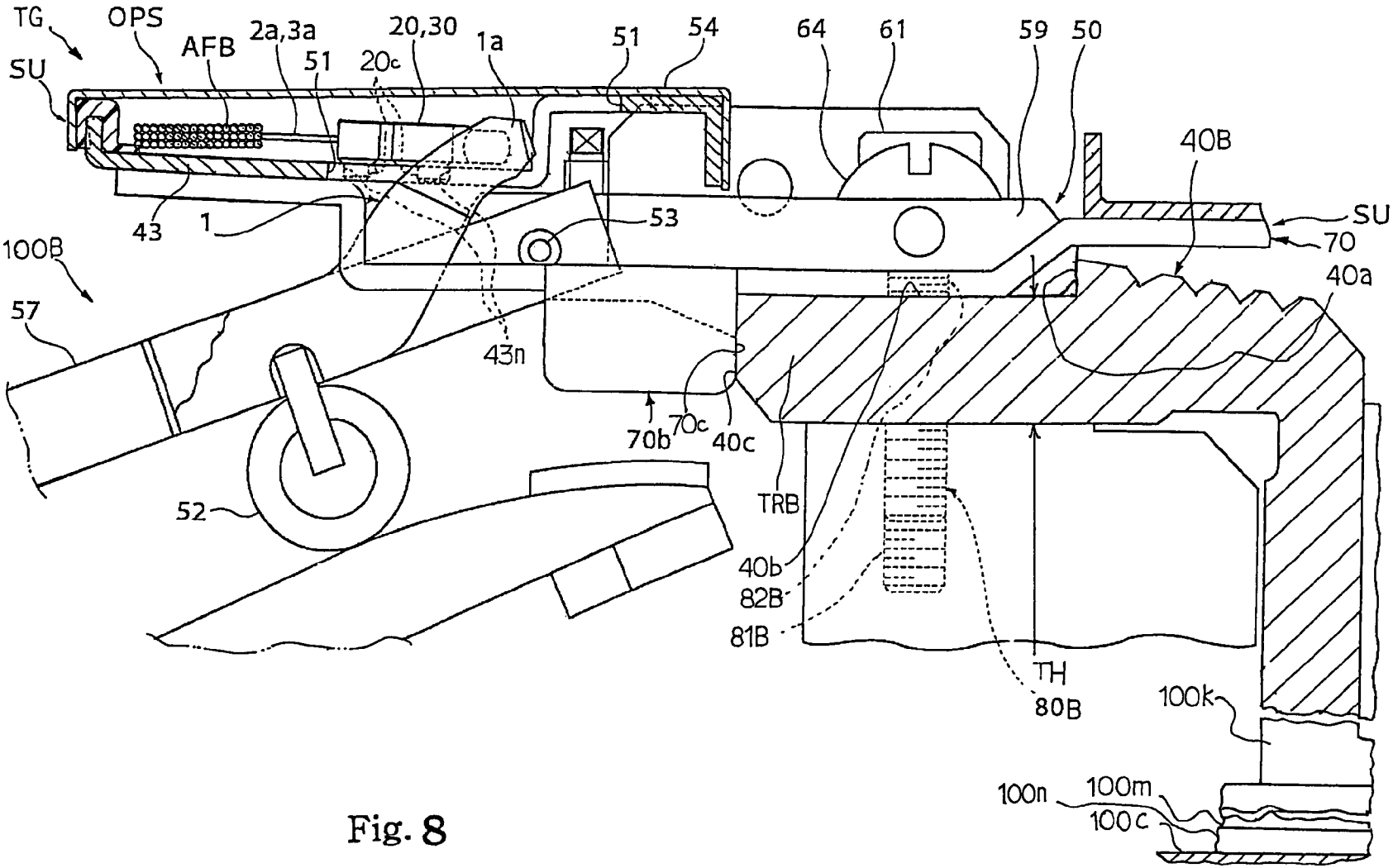
FIG. 8 is a cross sectional view showing essential parts of yet another hybrid keyboard musical instrument according to the present invention.

FIG. 8 shows the hammer sensor unit SU secured to a shank flange rail 40B of the acoustic piano 100 at the target relative positions in the fore-and-aft direction, lateral direction and up-and-down direction. The hammer sensor unit SU forms a part of the electronic tone generating system TG, which in turn forms parts of a hybrid keyboard musical instrument according to the present invention together with an acoustic piano 100B.

The hybrid keyboard musical instrument implementing the third embodiment is similar in structure to the hybrid keyboard musical instrument of the first embodiment except a positioning bolt 80B and the shank flange rail 40B. For this reason, description is focused on these different parts 80B and 40B, and other component parts are labeled with same references designating corresponding parts shown in FIGS. 1 to 6B without detailed description for the sake of simplicity.

Although the positioning bolts 80 make the framework FW located at the target relative position in the fore-and-aft direction, at the target relative position in the up-and-down direction and at the almost target relative position in the lateral direction, the positioning bolts 80B make the framework FW located at the target relative position in the fore-and-aft direction and at the almost target relative position, only. For this reason, the positioning bolt 80B has the lower threaded portion 81B and upper threaded portion 82B, only. Instead, the shank flange rail 40B has a terrace, the thickness TH of which is adjusted to a predetermined value. The predetermined value is determined in such a manner that the upper surface 40*b* keeps the bottom surface of the framework FW spaced from the gray scales 1*a* by the proper distance.

While the worker is assembling the framework FW with the shank flange rail 40B, the worker is expected to make the elongated holes 60*a*, 65*a* and 70*a* simply pass through the positioning bolts 80B, and, thereafter, to locate the framework FW at the target relative position in the lateral direction. Thus, the shank flange rail 40B makes the assembling work further easy and speedy.

The hybrid keyboard musical instrument implementing the second embodiment achieves all the advantages of the first embodiment by virtue of the positioning bolts 80A, the well-finished surfaces 40*a*, 40*b* and 40*c*, reference block 70*b*, inspection hole 4*a* and ring spacers 83A. The locator 62 also makes the reassembling work easy and speedy as similar to that in the first embodiment.

Moreover, neither spacer nut 83 nor ring spacer 83A is required for the positioning work. The number of the component parts is reduced, and the production cost is further reduced.

Although particular embodiments of the present invention have been shown and described, it will be apparent to those skilled in the art that various changes and modifications may be made without departing from the spirit and scope of the present invention.

A hybrid keyboard musical instrument according to the present invention may include the automatic playing system together with or instead of the hammer stopper HS and electronic tone generating system TG.

A hybrid keyboard musical instrument may be fabricated on the basis of an upright piano. In the upright piano, hammers are supported by a center rail, and the center rail is shared between the hammers and a hammer sensor unit s similar to the shank flange rail. Well finished surfaces are prepared for the shank flanges and the framework for the positioning, and positioning bolts and an inspection hole make it possible to exactly locate the hammer sensors at the target relative positions in the three directions.

Another hybrid keyboard musical instrument may be fabricated on the basis of another sort of acoustic keyboard musical instrument such as, for example, a harpsichord, an organ or a celesta. Thus, the grand piano and upright piano do not set any limit to the technical scope of the present invention.

In the above-described hammer sensor unit SU, the hammer sensor unit SU monitors the hammers 50, and produces the hammer position signals representative of the current hammer positions. However, this feature does not set any limit to the technical scope of the present invention. A hammer sensor unit may detect the velocity or acceleration of the hammers, because the data processor can determine the hammer motion through an analysis on these physical quantities.

The tone generator TN and sound system SS are not indispensable features of the present invention, because a hybrid keyboard musical instrument may transmit the music data codes to another musical instrument or a data storage.

The spacer nut 83 and threaded portions 81/82 may be monolithic. Bolts, which make the shank flange rail secured to the action brackets, may be different from bolts, which makes the framework FW secured to the shank flange rail. Otherwise, the positioning bolts may be further used for the connection between the shank flange rail and the action brackets.

The holes 60*a*, 65*a* and 70*a* may be elongated over the width of the slits 51 in so far as the length is less than the pitches of the array of hammers 50.

In the above-described embodiments, the positioning bolts 80, 80A and 80B are expected to not only integrate the framework FW with the shank flange rail 40 and 40B but also locate the frame work FW at the target relative position in the fore-and-aft direction and at the almost target relative position in the lateral direction. The two functions may be accomplished by different parts. In this instance, the upper threaded portion 81, 81A and 81B may be removed from the positioning bolts 80, 80A and 80B.

The locator 62 may be held in contact with another surface of the hammer shank flange. Otherwise, the locator 62 is formed with a nail, and an alignment mark, which is indicated by the tip of the nail, is formed on the upper surface of the hammer shank flange 59.

The hammer sensors 10/19/20/30/AFB/1 do not set any limit to the technical scope of the present invention. Another hammer sensor may be implemented by an array of reflection type photo-couplers on the framework FW and reflection plates attached to the hammer shanks 57. A combination between a photo-interrupter and a shutter plate may serve as a hammer sensor for each hammer.

Even though the shank flange rail 40/40B is separated into plural parts, the present invention is applicable to it.

The present invention may appertain to another sort of sensors incorporated in a hybrid keyboard musical instrument. For example, key sensors monitor black and white keys, and a balance rail offers the fulcrums of the key motion to the black and white keys. In this instance, a framework of the key sensor unit may be supported by the balance rail, and well-finished surfaces and positioning bolts make it possible to exactly locate the key sensors on the framework at target relative positions in the three directions.

Claim languages are correlated with the component parts of the above-described embodiments as follows.

The shank flange rail 40 serves as a "reference common member". The black and white keys 56, action units ACT and hammers 50 as a whole constitute "plural link works", and the hammers 50 are corresponding to "certain links". The strings 100*b* serve as a "tone generator". The electronic tone generating system TG is corresponding to an "electric system", and the hammer sensor unit SU serves as a "sensor unit". The light radiating sensor heads 20, light receiving sensor heads 30, light emitting unit 10, light detecting unit 19, optical fibers 2/3 and optical filters 1 as a whole constitute "sensors". In the first embodiment, the positioning bolts 80 serve as one of the "plural locators" for locating the sensors at target relative positions in the fore-and-aft direction, and the spacer nut 83 serve as another of the "plural locators" for locating the sensors at target relative positions in the up-and-down direction. The positioning bolts 80 are designed independently of the thickness of the spacer nut 83. As a result, the sensors are located at the target relative positions independently determined at least in the fore-and-aft direction and up-and-down direction. Similarly, the ring spacer 83A and well-finished surface 40*b* serves as the locator in the up-and-down direction in the second embodiment and third embodiment, respectively. The well-finished vertical surfaces 40*a*/40*c* may form the locator together with the positioning bolts 80, 80A or 80B.

The connector plates 60, 65 and 70 formed with the elongated holes 60*a*, 65*a* and 70*a* form the locator defined in a dependent claim together with the positioning bolts 80, 80A or 80B The action brackets 100*k* are corresponding to a "support member". The optical filters 1 serve as "optical plates", and the light radiating sensor heads 20, light receiving sensor heads 30, light emitting unit 10, light detecting unit 19 and optical fibers 2/3 as a whole constitute "photo-couplers". The shank flange rail 40 serves as a "rail member". The action brackets 100*k* are corresponding to "brackets".

What is claimed is:

1. A hybrid keyboard musical instrument comprising:

an acoustic musical instrument including a cabinet including a common reference member providing centers of rotation and having a fore-and-aft direction, a lateral direction crossing said fore-and-aft direction at right angle and an up-and-down direction normal to a plane defined by said fore-and-aft direction and said lateral direction, link works independently actuated in a performance for specifying the pitch of tones to be produced and respectively having hammers supported by said common reference member so as to be rotated about said centers of rotation of said common reference member, and a tone generator energized through said hammers, so as to produce said tones at said pitch specified through the actuated link works in cooperation with said hammers;

an electric system including a sensor unit having a framework supported by said common reference member and sensors supported by said framework and converting a physical quantity expressing the motion of said hammers to detecting signals, and a data processor connected to said sensors and producing pieces of music data through an analysis on said physical quantity; and plural locators provided on said common reference member, and engaged with said framework so as to locate said sensors at target relative positions in the vicinity of said centers of rotation with respect to said certain links independently determined in at least said fore-and-aft direction and said up-and-down direction.

2. The hybrid keyboard musical instrument as set forth in claim 1, in which one of said plural locator causes said framework to retain said sensors at said target relative positions in said fore-and-aft direction, and another of said plural locators causes said framework to retain said sensors at said target relative positions in said up-and-down direction.

3. The hybrid keyboard musical instrument as set forth in claim 2, in which projections are embedded in said common reference member so as to serve as said one of said plural locators together with a part of said framework formed with holes through which said projections pass.

4. The hybrid keyboard musical instrument as set forth in claim 3, in which stud bolts serve as said projections, and said common reference member is connected to a support member by means of said stub bolts.

5. The hybrid keyboard musical instrument as set forth in claim 2, in which spacers are inserted between said common reference member and said framework so as to serve as said another of said locators.

6. The hybrid keyboard musical instrument as set forth in claim 5, in which said spacers are held in threaded engagement with projections serving as said one of said plural locators together with a part of said framework formed with holes.

7. The hybrid keyboard musical instrument as set forth in claim 5, in which a well-finished surface of said common reference member serves as said another of said plural locators.

8. The hybrid keyboard musical instrument as set forth in claim 2, in which said one of said plural locator further causes said framework to retain said sensors around target relative positions in said lateral direction.

9. The hybrid keyboard musical instrument as set forth in claim 8, in which projections embedded in said common reference member and a part of said framework formed with elongated holes serve as said one of said plural locators.

10. The hybrid keyboard musical instrument as set forth in claim 1, in which said sensors include optical plates attached to said certain links in the vicinity of said centers for modulating light depending upon an angle of said certain links measured from rest positions of said certain links and photo-couplers radiating said light to said optical plates and receiving the modulated light so as to convert said modulated light to said detecting signals.

11. The hybrid keyboard musical instrument as set forth in claim 10, in which said optical plates are formed with gray scales for varying the amount of said light passing therethrough depending upon said angle.

12. The hybrid keyboard musical instrument as set forth in claim 10, in which said photo-couplers includes light radiating sensor heads secured to said framework on a certain side of trajectories of said certain links and light receiving sensor heads secured to said framework on the other side opposite to said certain side and opposed to said light radiating sensor heads.

13. The hybrid keyboard musical instrument as set forth in claim 1, in which said acoustic musical instrument is a piano.

14. The hybrid keyboard musical instrument as set forth in claim 13, in which said piano includes plural combinations of keys, action units selectively actuated by said keys, said hammers driven for rotation by said action units and strings serving as said tone generator, opposed to said hammers and struck with said hammers for producing said tones.

15. The hybrid keyboard musical instrument as set forth in claim 14, in which said hammers are rotatably connected to a rail member serving as said common reference member.

16. The hybrid keyboard musical instrument as set forth in claim 15, in which said rail member is secured to brackets supported by said cabinet by means of stud bolts, and said stud bolts serve as one of said plural locators in said fore-and-aft direction together with a part of said framework formed with holes.

17. The hybrid keyboard musical instrument as set forth in claim 16, in which spacer nuts are held in threaded engagement with said stud bolts for serving as another of said plural locators in said up-and-down direction.

18. The hybrid keyboard musical instrument as set forth in claim 16, in which said framework has a part formed with elongated holes through which said stud bolts pass for locating said sensors in the vicinity of target relative positions in said lateral direction.

19. The hybrid keyboard musical instrument as set forth in claim 18, further comprising a locator secured at one portion thereof to said framework and having another portion indicating a reference portion of one of said hammers so as to locate said sensors at said target relative positions in said lateral direction.

* * * * *